US011589631B2

(12) United States Patent
Whitesell et al.

(10) Patent No.: US 11,589,631 B2
(45) **Date of Patent: *Feb. 28, 2023**

(54) HELMET WITH INTEGRATED SHOULDER PAD

(71) Applicant: BELL SPORTS, INC., Scotts Valley, CA (US)

(72) Inventors: Scott S. Whitesell, Boulder Creek, CA (US); Scott R. Allen, Scotts Valley, CA (US); Christopher T. Pietrzak, Ben Lomond, CA (US); Allen Bischofberger, Ben Lomond, CA (US); Julio Valencia, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 22 days.

This patent is subject to a terminal disclaimer.

(21) Appl. No.: 17/171,189

(22) Filed: Feb. 9, 2021

(65) Prior Publication Data

US 2021/0161240 A1 Jun. 3, 2021

Related U.S. Application Data

(63) Continuation of application No. 15/880,042, filed on Jan. 25, 2018, now Pat. No. 10,939,721.

(Continued)

(51) Int. Cl.

*A42B 3/10* (2006.01)
*A42B 3/04* (2006.01)

(Continued)

(52) U.S. Cl.

CPC ..... *A42B 3/105* (2013.01); *A41D 13/0512* (2013.01); *A42B 3/0406* (2013.01); *A42B 3/0473* (2013.01); *A42C 2/002* (2013.01)

(58) Field of Classification Search

CPC ..... A42B 3/12; A42B 3/10; A42B 3/0406; A42B 3/105; A42B 3/0473; A42B 3/125;

(Continued)

(56) References Cited

U.S. PATENT DOCUMENTS 3,039,108 A * 6/1962 Lohrenz ..... A42B 3/10 2/415
3,134,106 A * 5/1964 Shaffer ..... A42B 3/0473 2/468

(Continued)

FOREIGN PATENT DOCUMENTS

DE 19822960 A1 * 12/1998 ..... A42B 3/0473
DE 19822960 A1 12/1998

(Continued)

OTHER PUBLICATIONS

Partial Supplemental European Search Report cited in corresponding European Application No. 18744316.3 dated Jul. 15, 2020.

(Continued)

*Primary Examiner* — Jillian K Pierorazio

(74) *Attorney, Agent, or Firm* — Walter M. Egbert, III; Richard J. Brown; Reed Smith LLP

(57) ABSTRACT

A helmet body includes an outer shell and an energy management liner with an outer shell lower edge extending between the inner surface and the outer surface of the outer shell. At least two shoulder pad recesses are positioned at a lower edge of the outer shell on a respective left and right sides of the helmet. The energy management liner is adjacent to the inner surface of the outer shell and includes at least two shoulder pads formed of a foamed energy management material. Each of the at least two shoulder pads is received into one of the at least two shoulder pad recesses on the respective left or right side of the helmet, each shoulder pad (Continued)

extending from inside of the outer shell to across at least a majority of a width of the lower edge of the outer shell.

13 Claims, 11 Drawing Sheets

Related U.S. Application Data

(60) Provisional application No. 62/450,471, filed on Jan. 25, 2017.

(51) Int. Cl.
*A42C 2/00* (2006.01)
*A41D 13/05* (2006.01)

(58) Field of Classification Search
CPC ..... A42B 3/127; A41D 13/0512; A41D 2600/102; A61F 5/055
See application file for complete search history.

(56) References Cited

U.S. PATENT DOCUMENTS 3,497,872 A * 3/1970 Mitchell ..... A63B 71/10 2/468
4,094,015 A * 6/1978 Howard ..... A63B 71/10 2/415
4,573,222 A * 3/1986 Zago ..... A42B 3/326 D29/107
4,598,430 A * 7/1986 Nava ..... A42B 3/326 2/424
4,638,510 A 1/1987 Hubbard
5,095,550 A * 3/1992 Perlinger ..... A42B 3/105 2/410
5,155,869 A * 10/1992 Ralli ..... A41D 27/20 2/268
5,287,562 A * 2/1994 Rush, III ..... A42B 3/0473 2/415
5,295,271 A * 3/1994 Butterfield ..... A42B 3/0473 2/424
5,351,342 A 10/1994 Garneau
5,353,437 A 10/1994 Field et al.
5,444,870 A * 8/1995 Pinsen ..... A42B 3/0473 2/468
5,450,631 A 9/1995 Egger
5,493,736 A * 2/1996 Allison ..... A42B 3/0473 2/416
5,546,601 A * 8/1996 Abeyta ..... A63B 71/1291 2/467
6,591,430 B1 * 7/2003 Sledge ..... A42B 3/0473 2/468
6,711,751 B1 * 3/2004 Muskovitz ..... A42B 3/12 2/10
6,862,749 B1 * 3/2005 Krause ..... A42B 3/105 2/909
6,874,170 B1 * 4/2005 Aaron ..... A42B 3/0473 2/468
7,380,290 B2 6/2008 Mothaffar
8,074,301 B2 12/2011 Mothaffar
8,327,465 B2 * 12/2012 Arai ..... A42B 3/0473 2/415
8,566,967 B2 10/2013 Janisse et al.
8,615,819 B2 * 12/2013 Kerr ..... A41D 13/0512 2/459
9,220,311 B1 * 12/2015 Baldi ..... A42B 3/00
D749,793 S * 2/2016 Shida ..... D29/122
9,462,841 B1 10/2016 Popejoy
2005/0278833 A1 12/2005 Pierce
2006/0212998 A1 * 9/2006 Gath ..... A42B 3/30 2/423
2007/0156072 A1 * 7/2007 Leatt ..... A42B 3/0473 602/18
2009/0044314 A1 * 2/2009 Newman ..... A42B 3/0473 2/468
2009/0126085 A1 5/2009 Gale
2009/0188022 A1 7/2009 Durocher et al.
2010/0088809 A1 * 4/2010 Leatt ..... A61F 5/055 2/468
2010/0235973 A1 * 9/2010 Mazzarolo ..... A61F 5/055 2/468
2010/0281603 A1 11/2010 Ho
2010/0286580 A1 * 11/2010 Leatt ..... A61F 5/055 602/18
2011/0004980 A1 * 1/2011 Leatt ..... A42B 3/326 2/468
2012/0174294 A1 * 7/2012 Sackett ..... A42B 3/127 2/414
2012/0291183 A1 * 11/2012 Janisse ..... A42B 3/0473 2/411
2012/0291189 A1 11/2012 Chambers et al.
2013/0309435 A1 * 11/2013 Boursier ..... B29C 70/545 428/53
2013/0340148 A1 12/2013 Arai
2014/0109305 A1 * 4/2014 Kerr ..... A63B 71/1291 2/461
2014/0223644 A1 * 8/2014 Bologna ..... A42B 3/326 2/414
2014/0259311 A1 * 9/2014 Murakami ..... A42B 3/281 2/411
2015/0250248 A1 * 9/2015 Jacobsen ..... A42B 3/06 2/421
2016/0213086 A1 * 7/2016 Nagely ..... A41D 13/0531
2017/0347738 A1 * 12/2017 Linares ..... A42B 3/20
2018/0110656 A1 * 4/2018 Ambring ..... A61F 9/06

FOREIGN PATENT DOCUMENTS

EP 1743538 A2 * 1/2007 ..... A42B 3/127
GB 2451429 A * 2/2009 ..... A42B 3/185
WO WO-2007050024 A1 * 5/2007 ..... A41D 13/018
WO 2007077368 A2 7/2007
WO WO-2007077368 A2 * 7/2007 ..... A41D 13/0512

OTHER PUBLICATIONS

Extended European Search Report for EP Application 22172647.4, dated Oct. 11, 2022.

* cited by examiner

HELMET WITH INTEGRATED SHOULDER PAD

RELATED APPLICATIONS

This application is a continuation of U.S. patent application Ser. No. 15/880,042, filed Jan. 25, 2018, which claims the benefit of provisional patent application 62/450,471, filed Jan. 25, 2017, titled "Helmet with Integrated Shoulder Pad," the entirety of the disclosures of which are incorporated by this reference.

TECHNICAL FIELD

Aspects of this document relate generally to helmets having shoulder pads, and more specifically to a helmet comprising shoulder pads and methods for assembling a helmet.

BACKGROUND

Protective headgear and helmets have wide uses. In certain sports or recreational activities, the wearer of a helmet moves his or her head and body quickly. Often, this causes the underside of the helmet shell to bump into the shoulder and collar bone of the rider. As a result, the shoulder of the wearer can be injured from the impact of the helmet to the shoulder. At times, the wearer's collarbone may even be broken from such impacts.

SUMMARY

According to an aspect of the disclosure a helmet may comprise a helmet body including an outer shell including an outer shell lower edge of the outer shell and at least one shoulder pad recess in the outer shell lower edge of each of the respective left and right sides of the helmet, and an energy management liner, a majority of the energy management liner disposed inside the outer shell, the energy management liner comprising two shoulder pad assemblies, each shoulder pad assembly comprising a first portion formed of expanded polystyrene (EPS), at least one anchor surrounded by and extending from the first portion, and a second portion formed of expanded polypropylene (EPP) and co-molded to the first portion around the at least one anchor, the second portion comprising a shoulder pad extending into the shoulder pad recess on the respective left or right side of the helmet, the shoulder pad extending from the first portion across at least a majority of a width of the outer shell lower edge.

Particular embodiments of the disclosure may comprise one or more of the following features. The second portion of the energy management liner may comprise a chinbar portion extending into a chinbar of the helmet body. Each of the at least two shoulder pads may also extend away from the outer shell lower edge beyond its respective shoulder pad recess. One or more cheek pad magnets mounted on the first portion of the energy management liner.

According to an aspect of the disclosure, a helmet may comprise an outer shell comprising an inner surface, an outer surface, and an outer shell lower edge extending between the inner surface and the outer surface, the outer shell further comprising at least two shoulder pad recesses positioned at a lower edge of the outer shell on a respective left and right sides of the helmet, and an energy management liner adjacent to the inner surface of the outer shell and comprising at least two shoulder pads formed of a foamed energy management material, each of the at least two shoulder pads received into one of the at least two shoulder pad recesses on the respective left or right side of the helmet, each shoulder pad extending from inside of the outer shell to across at least a majority of a width of the lower edge of the outer shell.

Particular embodiments of the disclosure may comprise one or more of the following features. Each shoulder pad may also extend away from the outer shell lower edge beyond its respective shoulder pad recess. The energy management liner may comprise a first portion, at least one anchor, and a second portion. The first portion formed of a first material. The at least one anchor may be formed of a third material harder than the first material extending from within the first portion. The second portion formed of a second material co-molded to the first portion around the at least one anchor. One or more cheek pad magnets mounted to the first portion of the energy management liner. The energy management liner may comprise the first portion formed of expanded polystyrene (EPS) and the second portion formed of expanded polystyrene (EPP). Each of the at least two shoulder pads may be part of the second portion of the energy management liner and also formed of EPP. The second portion of the energy management liner may extend into a chinbar of the helmet body.

According to an aspect of the disclosure, a method of assembling a helmet energy management liner may comprise placing one or more anchors of a third material at least partially into a first mold, injecting a first material softer than the third material into the first mold to form a first portion of the energy management liner around at least part of each of the one or more anchors, placing an uncovered portion of the one or more anchors into a second mold, and injecting a second material different from the first material and the third material into the second mold to co-mold a second portion of the energy management liner onto the first portion of the energy management liner and around the uncovered portion of the one or more anchors.

Particular embodiments of the disclosure may comprise one or more of the following features. The first material may be expanded polystyrene (EPS) and the second material may be expanded polypropylene (EPP). Injecting the second material may further comprise forming at least two shoulder pads integral with the second portion of the energy management liner to form a shoulder pad assembly. Mounting the shoulder pad assembly to the helmet with the at least two shoulder pads extending from inside of an outer shell of the helmet and received in at least two shoulder pad recesses of the outer shell of the helmet. Mounting the shoulder pad assembly may further comprise mounting the shoulder pad assembly to the helmet with a chinbar portion of the second portion extending into a chinbar of the helmet.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material, or acts in support of the function. Thus, even when the claims recite a "means for performing the function of . . . " or "step for performing the function of . . . ," if the claims also recite any structure, material, or acts in support of that means or step, or to perform the recited function, it is the clear intention of the inventors not to invoke the provisions of 35 U.S.C. § 112, ¶6. Moreover, even if the provisions of 35 U.S.C. § 112, ¶6, are invoked to define the claimed aspects, it is intended that these aspects not be limited only to the specific structure, material, or acts that are described in the preferred embodiments, but in addition, include any and all structures, material, or acts that perform the claimed function as described in alternative embodiments or forms in the disclosure, or that are well-known present or later-developed, equivalent structures, material, or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1A:
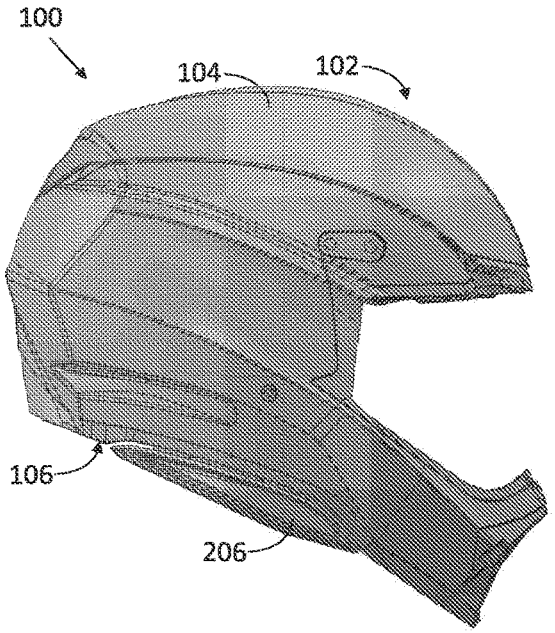
FIG. 1A is a side view of a helmet having shoulder pads.

While this disclosure includes embodiments in many different forms, they are shown in the drawings and will herein be described in detailed particular embodiments with the understanding that the present disclosure is to be considered as an exemplification of the principles of the disclosed methods and systems, and is not intended to limit the broad aspect of the disclosed concepts to the embodiments illustrated.

Protective head gear and helmets have been used in a wide variety of applications and across a number of industries including recreation, sports, athletics, construction, mining, military defense, and others, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a user to releasably wear the helmet, and to ensure the helmet remains on the user's head during an impact.

Protective headgear or helmets can be used for a snow skier, cyclist, football player, hockey player, baseball player, lacrosse player, polo player, climber, auto racer, motorcycle rider, motocross racer, snowboarder or other snow or water athlete, sky diver, or any other athlete, recreational or professional, in a sport. Other non-athlete users such as workers involved in industry, including without limitation construction workers or other workers or persons in dangerous work environments can also benefit from the protective headgear described herein, as well as the system and method for providing the protective head gear.

Helmets function to provide protection while minimizing interference with an activity. The shape of a helmet may be adapted to provide both protection and comfort (e.g. allowing ventilation and variation of sizes). Some helmets are made of two or more bodies of energy-absorbing material formed in shapes that would be difficult, if not impossible, to achieve in a single molded piece.

Various implementations and embodiments of protective helmets according to this disclosure comprise a protective shell. The protective shell may be formed of an energy absorbing material such as expanded polystyrene (EPS), expanded polyurethane (EPU), expanded polyolefin (EPO), expanded polypropylene (EPP), or other suitable material. The energy absorbing material can be used as part of a hard-shell helmet such as skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material may comprise one or more layers of EPP and provide more flexibility. Alternatively, the energy absorbing material may be part of an in-molded helmet such as a bicycle helmet. An outer shell, such as a layer of stamped polyethylene terephthalate or a polycarbonate shell, may be included on an outer surface of the protective shell of the helmet and be bonded directly to the energy management liner.

Contemplated as part of this disclosure is a helmet having shoulder pads as well as a method of assembling a helmet.

FIGS. 1A-2B show different views of a helmet 100 comprising a helmet body 102. A helmet may further comprise a fit system within the helmet, which may be as simple as a chin strap or may be more complex and include adjustment pieces within the helmet body. The fit system couples to the helmet body 102 and is accessible to the wearer from inside and/or outside the helmet body to fit and adjust the helmet to the wearer's head.

Figure 2A:
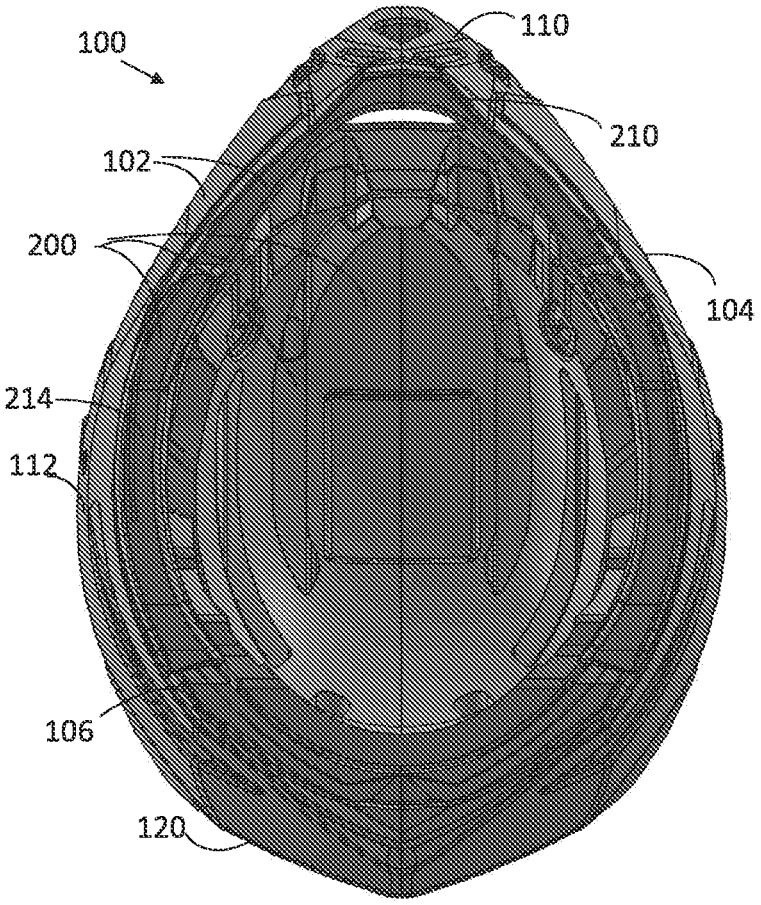
FIG. 2A is a bottom view of the helmet shown in FIG. 1A.
Figure 2B:
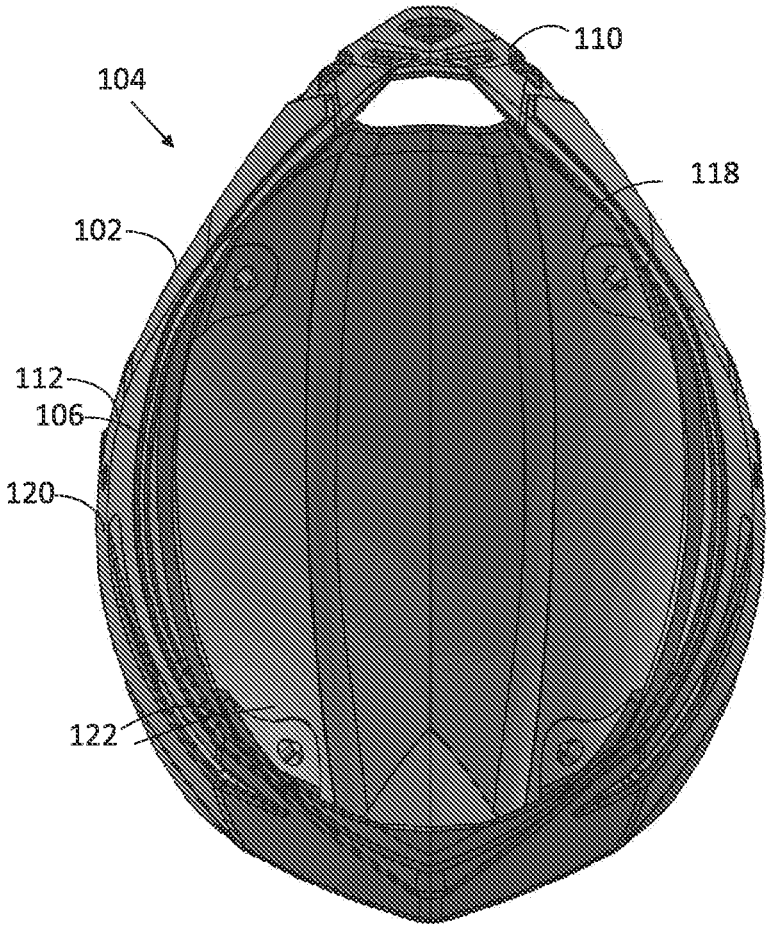
FIG. 2B is a bottom view of the outer shell of the helmet shown in FIG. 2A with the inner liner removed.

The helmet body comprises an outer shell 104 and an energy management liner 200 disposed adjacent the inner surface 118 of the outer shell 104 (FIGS. 2A and 2B). The majority of the energy management liner 200 is disposed inside the outer shell 104. The energy management liner 200 provides impact protection for the wearer and is not just a comfort liner.

The outer shell may comprise any materials known in the art of helmets, such as, but not limited to, one or more of ethylene vinyl acetate (EVA), Acrylonitrile butadiene styrene (ABS), polyvinylchloride (PVC), polycarbonate (PC), polyethylene terephthalate (PET), or other plastic, as well as resin, fiber, fiberglass, carbon fiber, textile, or other suitable material, whether cast, formed, molded, stamped, in-molded, injection molded, vacuum formed, or formed by another suitable process.

The energy management material may comprise any materials known in the art of helmets for use as energy management, such as, but not limited to, one or more of plastic, polymer, foam, or other suitable energy absorbing material that can flexibly deform with a hard outer shell to absorb energy and to contribute to energy management without breaking. The energy absorbing layer can be one or more layers of EPP, EPS or EVA, which can be used as an energy absorbing and energy attenuating material that is flexible and is able to withstand multiple impacts without being crushed or cracking. In other instances, EPP foam, EPS, EPU, or EPO can be used or in-molded for absorbing energy from an impact.

The outer shell 104 comprises an inner surface 118, an outer surface 120, and an outer shell lower edge or lower edge line of the helmet outer shell 106. The outer shell lower edge 106 is positioned along the sides 112 of the helmet outer shell 104. The outer shell 104 further comprises at least two shoulder pad recesses 124 at its bottom (FIG. 1B), recessed into the outer shell lower edge 106. The side 112 of the outer shell 104 also forms a nominal lower edge line 108 (FIG. 3), which is a continuous smooth line starting from the lower front edge 114 of the outer shell 104 to the lower rear edge 116 of the outer shell 104. The outer shell lower edge 106 indents upward relative to the nominal lower edge line 108 to form the shoulder pad recesses 124.

Figure 1B:
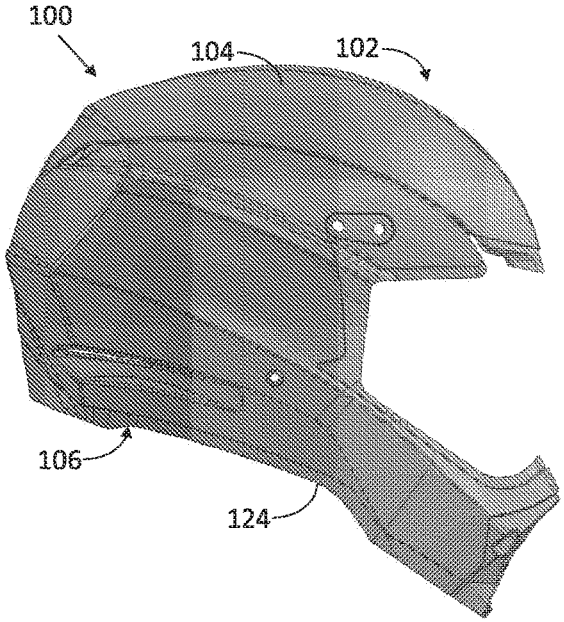
FIG. 1B is a side view of the helmet shown in FIG. 1A without shoulder pads installed.

The energy management liner 200 comprises at least two or more shoulder pads 206. The shoulder pads 206 are formed of foamed energy management material, e.g., EPP, EPS. FIGS. 1A and 2A show a helmet 100 having shoulder pads 206. FIGS. 1B and 2B show a helmet 100 of FIGS. 1A and 2A with the energy management liner 200, including the shoulder pads 206, removed to emphasize the outer shell lower edge 106 and recesses 124. Each of the shoulder pad recesses 124 is disposed on a respective left or right side of the helmet.

The shoulder pads may be formed of a soft, pliable, energy-absorbing material that elastically deforms, such as a foam, textiles, plastic, or other suitable material, that may be covered by a covering material like leather, vinyl, cloth, textile, or other film or sheet of material.

Figure 3:
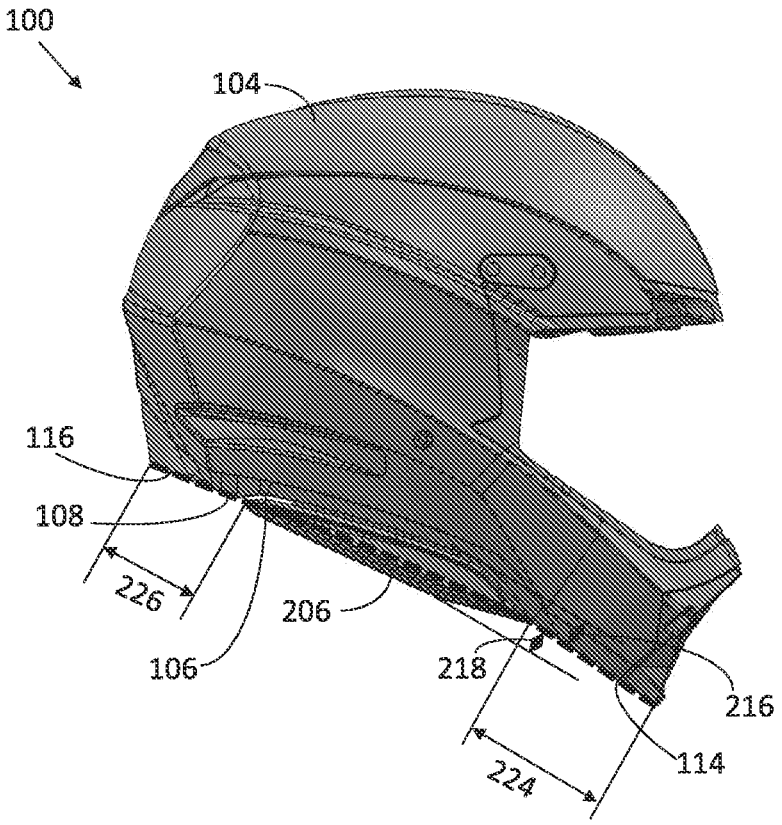
FIG. 3 is a side view of a helmet having shoulder pads.

Each of the shoulder pads 206 is received in one of the shoulder pad recesses 124. The shoulder pads 206 extend outward and downward from the sides 112 of the helmet such that the shoulder pads 206 extend across at least a majority of the width 122 (FIG. 2B) of the outer shell lower edge 106. In some embodiments, the shoulder pads 206 extend further downward from the outer shell beyond the nominal lower edge line 108 (FIG. 3). With shoulder pads installed in the helmet, the shoulder of the wearer contacts a shoulder pad, instead of the outer shell, when the wearer's head and body move to a point that the helmet bumps into the shoulder. The shoulder pads alleviate the impact of the helmet to the wearer's shoulder.

In particular embodiments, the height 216 of the shoulder pad above the nominal lower edge line 108 (FIG. 3) or between the nominal lower edge line 108 and the outer shell lower edge 106 may be in a range of 0-20 millimeters (mm), 0-10 mm, or 3-10 mm. The height 218 of the shoulder pad below the nominal lower edge line 108 (FIG. 3) may be in a range of 0-20 mm, 0-10 mm, or 3-10 mm.

In particular embodiments, the distance 224 between a front of the shoulder pads and a front of the helmet may be in a range of 5-13 centimeters (cm) (or 2-5 inches) (FIG. 3). The distance 226 between a rear of the shoulder pads and a rear of the helmet (FIG. 3) may be in a range of 2.5-7.5 cm (or 1-3 in.).

Figure 4A:
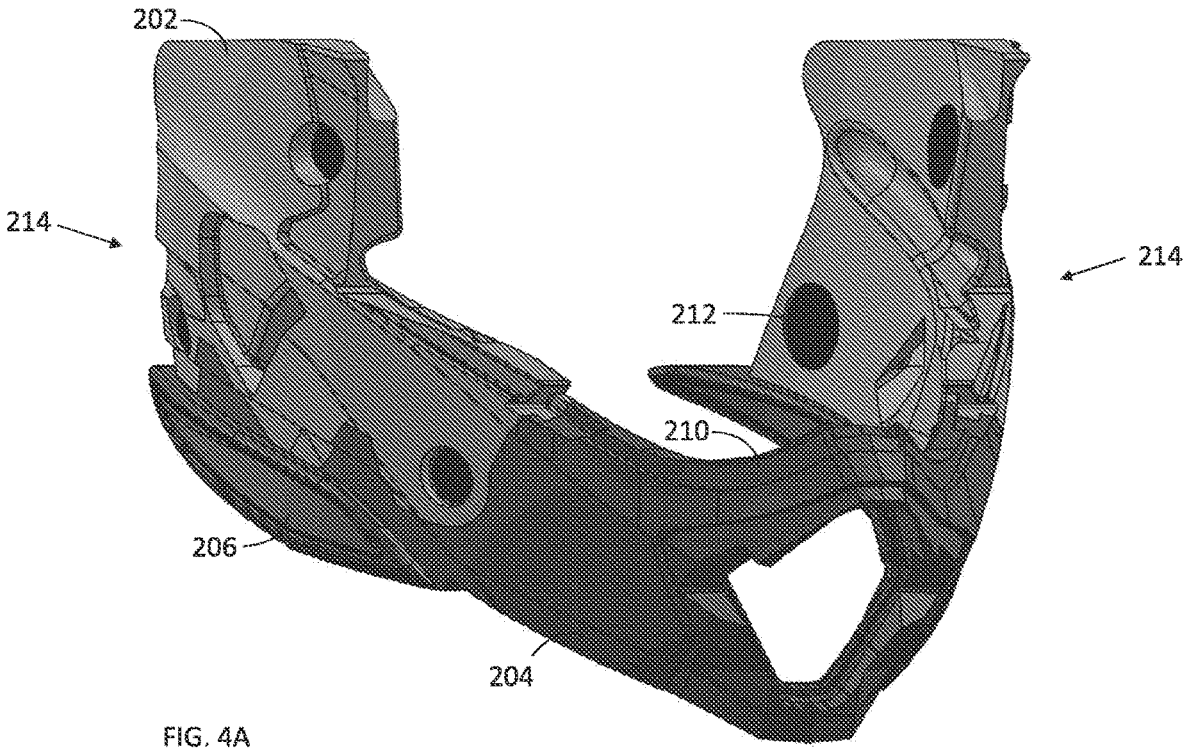
FIG. 4A is a perspective view of a shoulder pad assembly.
Figure 4B:
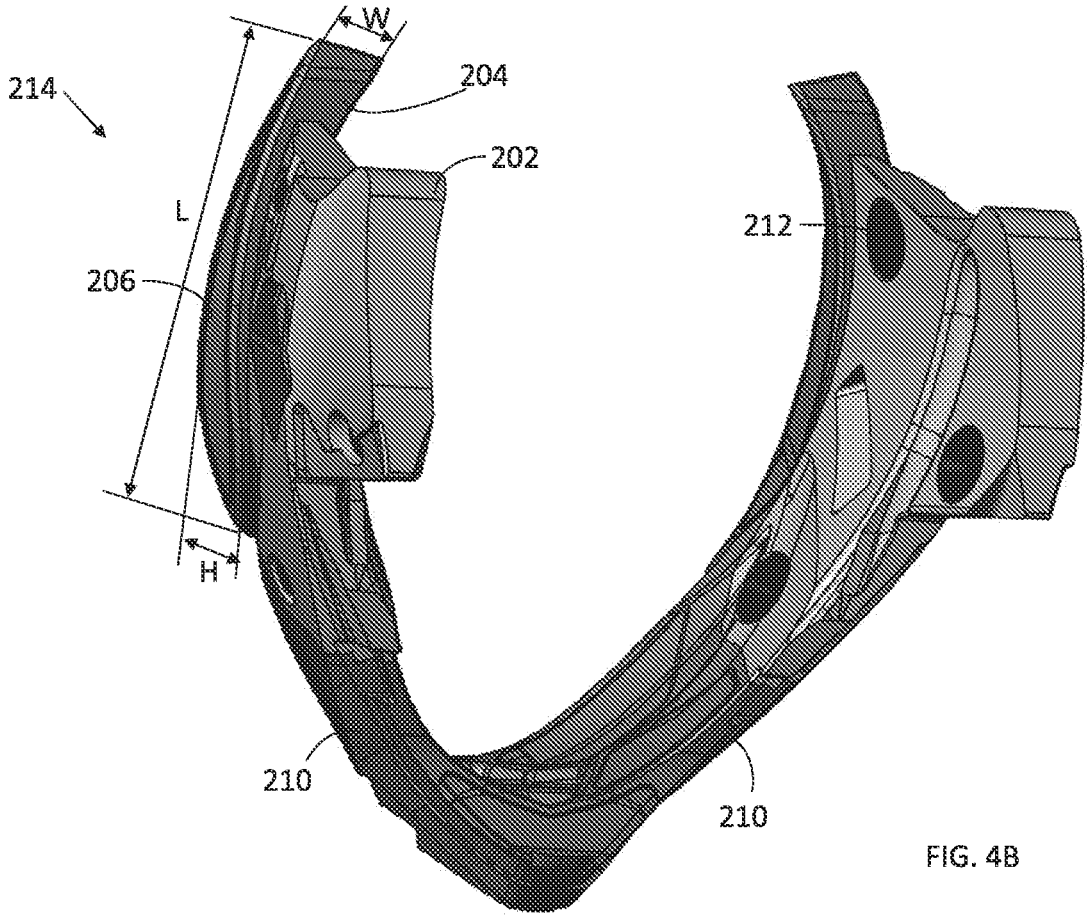
FIG. 4B is a top view of the shoulder pad assembly shown in FIG. 4A.

The shoulder pads may be in any desirable shape or have any desirable number of sides. In some instances, the shoulder pads may comprise a height H (FIG. 4B) in a range of 0.5-5.0 cm (or 0.2-2.0 in.), a length L in a range of 5-18 cm (or 2-7 in.), and a width W in a range of 1-4 cm (or 0.4-1.6 in.) (FIG. 4B). The width W is measured as the distance between a point in the outer side of the shoulder pad and a corresponding point on the inner side of the shoulder pad. The length L of the shoulder pad is measured as the distance between the front of the shoulder pad and the rear of the shoulder pad. The height H of the shoulder pad is measured as the distance between a point at the top surface of the shoulder pad and a corresponding point at a bottom surface of the shoulder pad. In the specific non-limiting embodiments illustrated in FIGS. 4A-4C, the shoulder pads are tapered such that a height H and a width W is greatest towards the middle or center of the length L, and then is tapered to a lesser height H and width W at the opposing ends of the length L. In other embodiments, the height H and the width W may be constant along the length L. The width of the shoulder pad may be the same as the width of the sidewall of the helmet body (e.g. the outer shell plus energy management liner, and optionally the comfort liner).

Each shoulder pad may be a stand-alone piece and be coupled to the helmet body via friction, magnets, hook- and loop fasteners, snaps, glue, or other means known in the art. Shoulder pads may also be integrated with other components of the energy management liner or comfort liner, for example, the shoulder pads may be integrated with cheek pads.

Figure 4C:
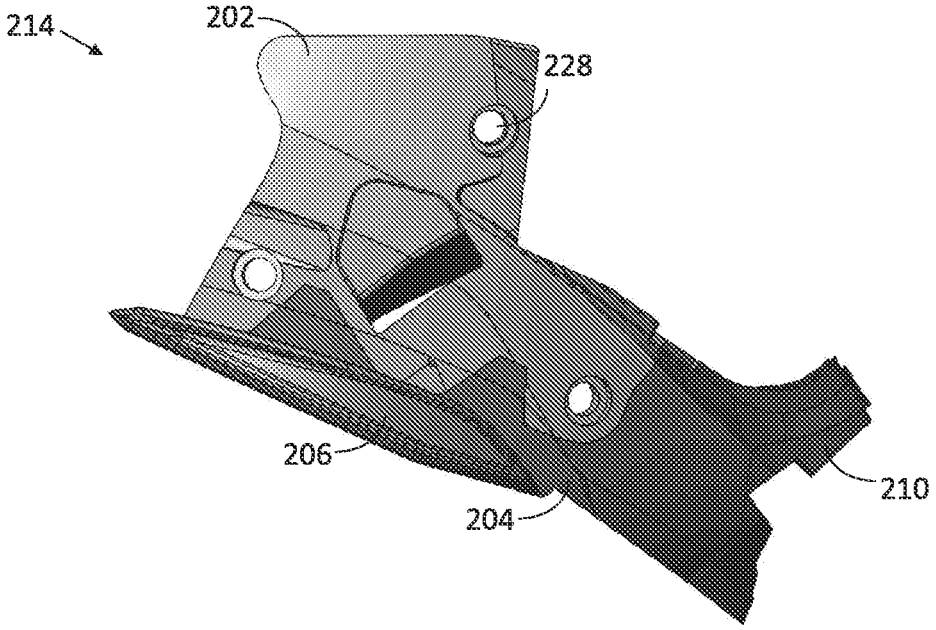
FIG. 4C is a side view of the shoulder pad assembly shown in FIG. 4A without cheek pad magnets.

Shoulder pads 206 may be a part of a shoulder pad assembly 214, which forms part of the energy management liner 200. FIGS. 2A and 2B illustrate the placement of the shoulder pad assembly 214 relative to the outer shell 104 of the helmet 100. FIGS. 4A-4C illustrate an example shoulder pad assembly 214, showing the perspective, top, and side view of the shoulder pad assembly 214.

Figure 5A:
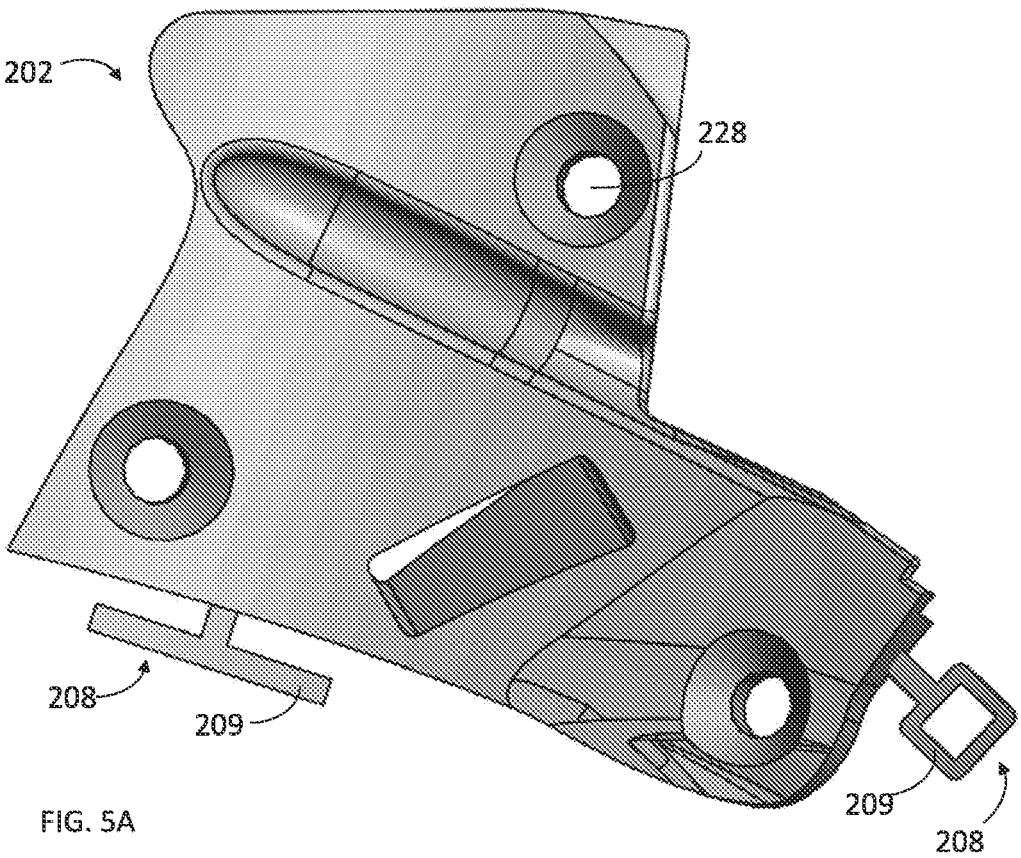
FIG. 5A shows a side view of a first portion of an energy management liner with anchors attached.
Figure 5B:
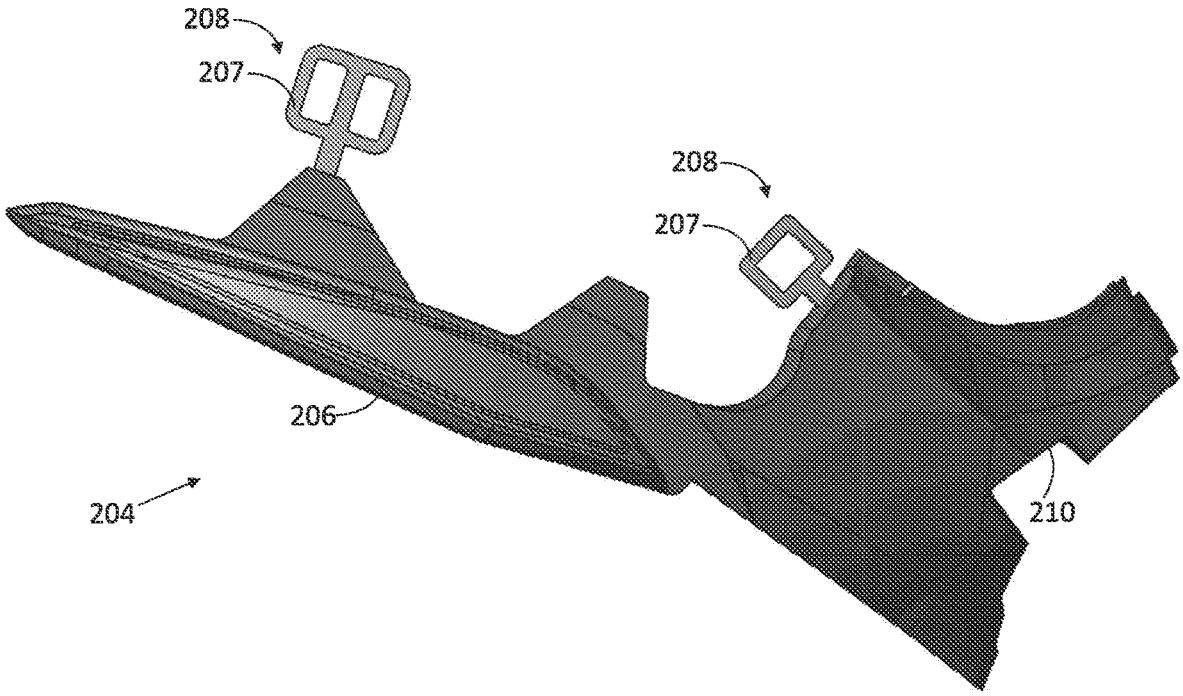
FIG. 5B shows a side view of the second portion of the energy management liner in FIG. 5A, where the second portion is attached with the anchors shown in FIG. 5A at the portions uncovered by the first portion.

A shoulder pad assembly 214 (FIG. 4C) comprises a first portion 202 of the energy management liner 200 (FIGS. 4C-5A), a second portion 204 of the energy management liner 200 (FIG. 4C, 5B), and one or more anchors 208 (FIGS. 5A-6B) connecting the first and second portions 202, 204 together. In the particular non-limiting embodiments shown in FIGS. 4C-5B, the shoulder pads 206 are be formed as part of the second portion 204. The shoulder pads 206 shown in FIGS. 4A and 4B extend sideways away from the remaining part of the shoulder pad assembly 214 so that the shoulder pads 206 can extend across a majority of the width of the outer shell lower edge. Anchors are not shown in the surface of the example assembled shoulder pad assembly 214 shown in FIGS. 4A-4C because one portion 207 of the anchors 208 is surrounded by the first portion 202 of the energy management liner 200, and the other portion 209 of the anchors 208 is surrounded by the second portion 204 of the energy management liner 200 (FIG. 5A). FIGS. 4C, 5A, and 5B depict the right-side views of the shoulder pad assembly or parts of the shoulder pad assembly 214. The corresponding parts on the left side of the shoulder pad assembly will be mirror images of those on the right side for most embodiments.

The first portion 202 of the energy management liner 200 is formed of a first material. The second portion 204 of the energy management liner 200 is formed of a second material, different from the first material. The anchors are made of a third material that is harder than the first and second materials. In some embodiments, the first material is EPS and the second material is EPP. The anchors may be formed of plastic, metal, nylon or other material.

The first portion 202 and the second portion 204 may be co-molded. In some embodiments, one or more anchors are used to help bind the first and second portions 202, 204 together. To assemble the energy management liner 200, one or more anchors are at least partially inserted into a first mold. A first material is then injected into the first mold and forms a first portion 202 of the energy management liner 200 with the anchors 208 extending out of the first portion 202 (FIG. 5A). After the first portion 202 is taken out of the first mold, at least the uncovered portions of the anchors, and in some cases portions or all of the first portion 202 of the energy management liner, and in some embodiments two (left and right) first portions 202, are placed inside a second mold. A second material is then injected into the second mold to form the second portion 204 of the energy management liner 200. The second portion 204 is formed around the portions of anchors uncovered by the first portion 202 and co-molded with the first portion 202. The order of making the first portion and the second portion may be reversed such that the second portion of the energy management liner is made before the first portion of the energy management liner.

Figure 6A:
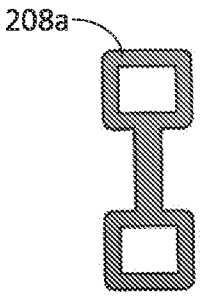
FIG. 6A shows an example of an anchor.
Figure 6B:
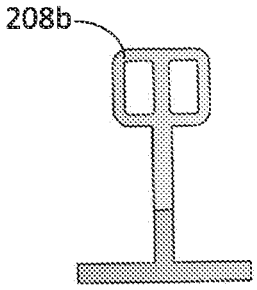
FIG. 6B shows another example of an anchor.

The anchors 208 comprise enlarged or extended arms or structures for the anchors to hold onto the first or second portions 202, 204 (FIGS. 6A and 6B). FIGS. 6A and 6B illustrate non-limiting examples of anchors 208*a*, 208*b*.

The energy management liner 200 may further comprise a chin bar portion 210 (FIGS. 2A, 4A-4C, and 5B). The chin bar portion 210 extends into the chin bar 110 of the helmet body 102 (FIG. 2A). The first portions 202 of the shoulder pads may be joined together through a single chin bar portion 210 that extends through the chin bar 110 of the helmet body 102 to join the two first portions 202 of the respective shoulder pad assemblies, or the chin bar portions 210 may be separated. In either case, however, each shoulder pad assembly includes its own chin bar portion 210.

The helmet 100 may further comprise cheek pad magnets 212. The cheek pad magnets 212 may be disposed on the first portion 202 of the energy management liner 200 (FIG. 4A-4B). The cheek pad magnets 212 may be disposed into the apertures 228 of the first portion 202 for installing the cheek pad magnets 212 (FIGS. 4C, 5A).

Figure 7:
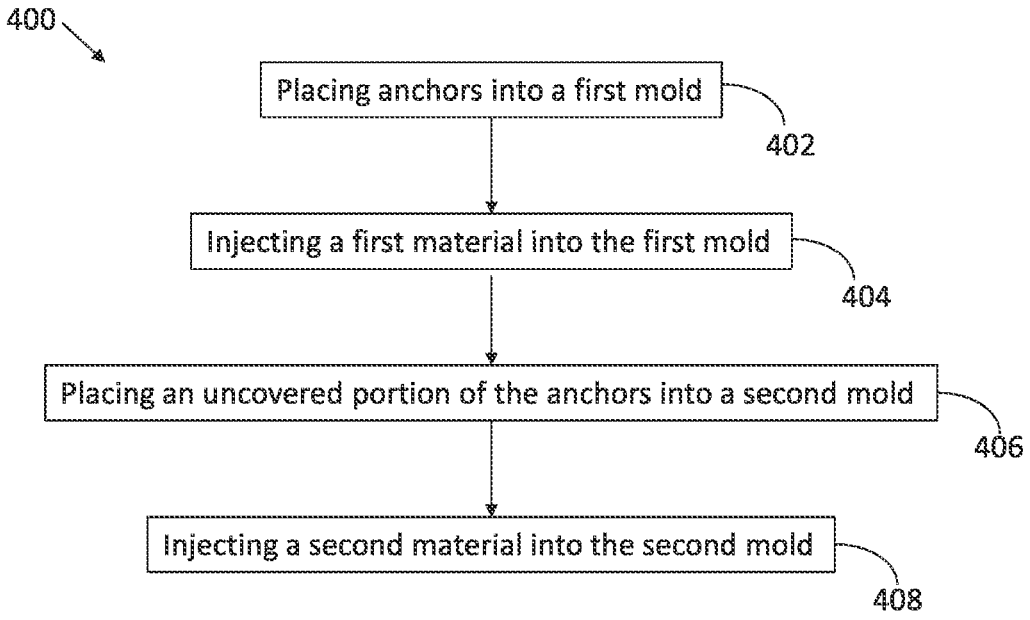
FIG. 7 is a flow chart of a method of assembling a helmet.

Methods of assembling a helmet energy management liner are also provided herein. FIG. 7 illustrates an example method (400) of assembling a helmet energy management liner. The method 400 comprises placing one or more anchors made of a third material at least partially into a first mold (402). The method 400 further comprises injecting a first material softer than the third material into the first mold to form a first portion of the energy management liner of the helmet around at least part of each of the one or more anchors (404). The method 400 further comprises placing at least uncovered portions of the anchors into the second mold (406) and injecting a second material into the second mold to co-mold a second portion of the energy management liner onto the first portion (408). The second portion is formed around the portion of the anchors uncovered by the first portion of the energy management liner. The second material is different from the first material and the third material. In some embodiments, the first material is EPS and the second material is EPP.

In some embodiments, injecting a second material into the second mold (408) includes forming at least two shoulder pads integral with the second portion of the energy management liner to form a shoulder pad assembly. The method 400 may further comprise mounting the shoulder pad assembly onto the helmet. The shoulder pads of the shoulder pad assembly extend from inside of the outer shell of the helmet and are received in one of the at least two shoulder pad recesses of the outer shell. In some embodiments, mounting the shoulder pad assembly further comprises mounting the shoulder pad assembly to the helmet with a chinbar portion of the second portion extending into a chinbar of the helmet body.

This disclosure, its aspects and implementations, are not limited to the specific components or assembly procedures disclosed herein. Many additional components and assembly procedures known in the art consistent with the intended helmets and methods of assembling a helmet will become apparent for use with implementations of the apparatus and methods in this disclosure. In places where the description above refers to particular implementations of protective helmets, it should be readily apparent that a number of modifications may be made without departing from the spirit thereof and that these implementations may be applied to other protective helmets. The presently disclosed implementations are, therefore, to be considered in all respects as illustrative and not restrictive, the scope of the disclosure being indicated by the appended claims rather than the foregoing description. All changes that come within the meaning of and range of equivalency of the description are intended to be embraced therein. Accordingly, for example, although particular helmets and methods of assembling a helmet are disclosed, such apparatus, methods, and implementing components may comprise any shape, size, style, type, model, version, class, grade, measurement, concentration, material, quantity, the like as is known in the art for such apparatus, methods, and implementing components, and/or the like consistent with the intended operation of the helmet and methods of assembling a helmet may be used.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

The invention claimed is:

1. A helmet comprising:

an outer shell including an outer shell lower edge, wherein a portion of the outer shell lower edge of each of a respective left side and a right side of the helmet indents upward to form at least one shoulder pad recess on respective left and right sides of the helmet body; and an energy management liner, a majority of the energy management liner disposed inside the outer shell, the outer shell and energy management liner inside the outer shell defining a first width, the energy management liner comprising two shoulder pad assemblies, each shoulder pad assembly partially disposed inside the outer shell, a portion not disposed inside the outer shell comprising a shoulder pad extending downward into the shoulder pad recess on the respective left side or right side of the helmet, the shoulder pad extending across a portion of the width of the outer shell lower edge, wherein the shoulder pad has a second width substantially the same as the first width and the shoulder pad is configured to to alleviate the impact of the helmet to a wearer's shoulder.

2. The helmet of claim 1, wherein the shoulder pad assembly comprises a chinbar portion extending into a chinbar of the helmet body.

3. The helmet of claim 1, wherein each of the shoulder pads also extends away from the outer shell lower edge beyond the respective shoulder pad recess into which each shoulder pad extends.

4. The helmet of claim 1, further comprising one or more cheek pad magnets mounted on the energy management liner.

5. The helmet of claim 1, wherein the energy management liner comprises expanded polypropylene (EPP).

6. The helmet of claim 1, wherein each shoulder pad assembly comprises:

a first portion formed of expanded polystyrene (EPS); and a second portion formed of expanded polypropylene (EPP), the second portion comprising the shoulder pad extending into the shoulder pad recess on the respective left or right side of the helmet.

7. The helmet of claim 1, wherein the shoulder pad comprises a length in a range of 2 to 7 inches and a height in a range of 0.2 to 2 inches.

8. A helmet comprising:

an outer shell including an outer shell lower edge, wherein a portion of the outer shell lower edge of each of a respective left side and a right side of the helmet indents upward to form at least one shoulder pad recess on respective left and right sides of the helmet body; and an energy management liner, a majority of the energy management liner disposed inside the outer shell, the outer shell and energy management liner inside the outer shell defining a first width, the energy management liner comprising two shoulder pad assemblies, each shoulder pad assembly partially disposed inside the outer shell, a portion not disposed inside the outer shell comprising a shoulder pad extending outward and downward into the shoulder pad recess on the respective left side or right side of the helmet, the shoulder pad extending across a portion of the width of the outer shell lower edge, wherein the shoulder pad is configured to alleviate the impact of the helmet to a wearer's shoulder.

9. The helmet of claim 8, wherein the shoulder pad assembly comprises a chinbar portion extending into a chinbar of the helmet body.

10. The helmet of claim 8, further comprising one or more cheek pad magnets mounted on the energy management liner.

11. The helmet of claim 8, wherein the energy management liner comprises expanded polypropylene (EPP).

12. The helmet of claim 8, wherein each shoulder pad assembly comprises:

a first portion formed of expanded polystyrene (EPS); and a second portion formed of expanded polypropylene (EPP), the second portion comprising the shoulder pad extending into the shoulder pad recess on the respective left or right side of the helmet.

13. The helmet of claim 8, wherein the shoulder pad comprises a length in a range of 2 to 7 inches and a height in a range of 0.2 to 2 inches.

* * * * *